US009254030B2

(12) United States Patent
Terry et al.

(10) Patent No.: US 9,254,030 B2
(45) Date of Patent: Feb. 9, 2016

(54) CARRYING DEVICE DUAL SHOULDER STRAP SYSTEM

(75) Inventors: Paul Terry, Park City, UT (US); Thomas Zebulon Franke, Salt Lake City, UT (US); Nathan M Kuder, Sandy, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 1063 days.

(21) Appl. No.: 12/712,315

(22) Filed: Feb. 25, 2010

(65) Prior Publication Data

US 2010/0243693 A1 Sep. 30, 2010

Related U.S. Application Data

(60) Provisional application No. 61/162,722, filed on Mar. 24, 2009.

(51) Int. Cl.

| | |
|---|---|
| ***A45F 3/04*** | (2006.01) |
| ***A45F 3/00*** | (2006.01) |
| ***A45F 3/14*** | (2006.01) |
| ***A45F 3/08*** | (2006.01) |

(52) U.S. Cl.

CPC ... *A45F 3/14* (2013.01); *A45F 3/04* (2013.01); *A45F 3/08* (2013.01); *A45F 3/047* (2013.01); *A45F 2003/045* (2013.01); *A45F 2003/142* (2013.01)

(58) Field of Classification Search

CPC ..... A45F 3/04; A45F 3/08
USPC ..... 224/633, 637, 645, 627, 631
See application file for complete search history.

(56) References Cited

U.S. PATENT DOCUMENTS 4,214,685 A 7/1980 Pletz
4,303,186 A 12/1981 Ollinger, IV (Continued)

FOREIGN PATENT DOCUMENTS

DE 102005055688 A1 5/2006
EP 2819700 A1 * 7/2002 ..... A45F 3/04

(Continued)

OTHER PUBLICATIONS

Ergon Bike Ergonomics product description—attached.

*Primary Examiner* — Justin Larson
*Assistant Examiner* — Lester L Vanterpool
(74) *Attorney, Agent, or Firm* — Trent Baker; Baker & Associates PLLC

(57) ABSTRACT

One embodiment of the present invention relates to a carrying system with an enclosure member and a shoulder attachment system. The shoulder attachment system includes a first and second shoulder strap individually coupled to the external surface of the enclosure member. The bottom ends of the first and second shoulder straps are intercoupled via a coupling member. The coupling member is slidably routed through a sleeve member within the internal region of the enclosure member. The sleeve member includes an internal channel having a cross-sectional shape that substantially matches the cross-sectional shape of the coupling member, thereby minimizing frictional resistance as the coupling member is translated through the sleeve member. The slidable intercoupling between the bottom ends of the first and second shoulder straps with respect to the enclosure member enables articulation of one shoulder strap to be balanced by corresponding articulation of the opposite shoulder strap.

16 Claims, 4 Drawing Sheets

(56) References Cited

U.S. PATENT DOCUMENTS

| | | | | | |
|---|---|---|---|---|---|
| 4,676,418 | A | | 6/1987 | Lowe | |
| 4,830,245 | A | * | 5/1989 | Arakaki | 224/628 |
| 5,005,744 | A | * | 4/1991 | Gleason | 224/630 |
| 5,114,059 | A | * | 5/1992 | Thatcher | 224/148.5 |
| 5,366,126 | A | * | 11/1994 | Dausien | 224/630 |
| 5,427,290 | A | * | 6/1995 | Thatcher | 224/148.2 |
| 5,573,166 | A | * | 11/1996 | Leja | 224/630 |
| 5,823,414 | A | * | 10/1998 | Gal et al. | 224/637 |
| 5,890,640 | A | * | 4/1999 | Thompson | 224/630 |
| 5,961,019 | A | | 10/1999 | Gleason et al. | |
| 5,971,244 | A | * | 10/1999 | Jaeger | 224/632 |
| 6,070,776 | A | * | 6/2000 | Furnary et al. | 224/627 |
| 6,626,342 | B1 | * | 9/2003 | Gleason | 224/633 |
| 6,637,631 | B2 | | 10/2003 | Lafoux | |
| 6,892,915 | B2 | * | 5/2005 | Mares | 224/630 |
| 7,028,873 | B1 | * | 4/2006 | Collier et al. | 224/628 |
| 7,287,677 | B2 | | 10/2007 | Reid | |
| 8,118,201 | B1 | * | 2/2012 | Calkin | 224/156 |
| 8,181,834 | B1 | * | 5/2012 | Howell | 224/630 |
| 8,181,835 | B2 | * | 5/2012 | Thatcher | 224/631 |
| 8,556,147 | B2 | * | 10/2013 | Howell | 224/630 |
| 2006/0289586 | A1 | | 12/2006 | Gregory | |
| 2008/0035686 | A1 | | 2/2008 | Gregory | |
| 2008/0203129 | A1 | | 8/2008 | Frei | |

FOREIGN PATENT DOCUMENTS

| | | | | | |
|---|---|---|---|---|---|
| EP | 1902646 | A1 | | 3/2008 | |
| FR | 2819700 | | | 1/2001 | |
| FR | 2819700 | A1 | * | 7/2002 | A45F 3/04 |
| JP | 8131256 | | | 5/1996 | |
| WO | WO2005122824 | A2 | | 12/2005 | |

* cited by examiner

CARRYING DEVICE DUAL SHOULDER STRAP SYSTEM

RELATED APPLICATIONS

This application claims priority to U.S. provisional application Ser. No. 61/162,722 filed Mar. 24, 2009, the contents of which are incorporated by reference.

FIELD OF THE INVENTION

The invention generally relates to backpacks and other carrying systems which include shoulder straps for user support. In particular, the present invention relates to a dual shoulder strap articulation system for improving performance of a carrying system.

BACKGROUND OF THE INVENTION

Bags and carrying cases are commonly used to transport items from one location to another. Items may be contained and supported within an internal enclosure during transportation. Most bags also include some form of user attachment system that allows a user to support the bag during transportation. Many types of user attachment systems are designed to be positioned on a user's body in a configuration that both supports the bag but does not require the use of appendages. For example, backpack shoulder straps may be individually looped around each of a user's shoulders to support the backpack in an orientation that does not require the user to hold the backpack in place with their arms. However, each type of user-attachment system possesses particular performance characteristics and limitations that affect the utility of the bag. For example, a single shoulder strap or messenger-style user attachment system is undesirable for exclusive support of a bag with loads of higher weight due to discomfort.

Bags and carrying cases may be further classified according to their overall shape, user-attachment system(s), and material of composition. One subset of carrying cases or bags includes a set of two shoulder straps for individually and simultaneously attaching around both of a user's shoulders. This form of bag is commonly referred to as a backpack. A backpack may also include other user-attachment systems in addition to the shoulder straps, such as waist belts, handles, single shoulder straps, etc. The enclosure portion of a backpack is primarily positioned on the dorsal torso region of the user, and the dual shoulder attachment system includes two straps that circumscribe the ventral side of the shoulders. Therefore, each of the straps encircle one of the user's shoulders respectively. The two shoulder straps are generally adjustable in length to accommodate different user torso shapes. The simultaneous encircling of a user's shoulders transfers the weight of the backpack contents or load to the user's shoulder region without requiring the user to support the enclosure portion in any manner with their hands or lower arms.

One of the problems with existing dual shoulder strap systems is the inability to effectively accommodate for opposing shoulder movements which occur during ambulation and/or incidental torso articulation. For example, when a user laterally leans to one side, the opposing shoulder is naturally raised with respect to the leaning shoulder. Conventional dual shoulder strap systems are rigidly individually coupled to the backpack; therefore, in circumstances such as the one described above, the straps force the user to perform additional work associated with muscular accommodation for the backpack load being tilted in a manner that matches the torso of the user. Over the course of extended use, a user may be forced to perform significant unnecessary work as a result of natural shoulder movements or leaning. In addition, conventional rigid individual coupling of shoulder straps with a heavy backpack load causes instability to the user in certain circumstances.

Therefore, there is a need in the industry for an efficient backpack dual shoulder strap system that accommodates for opposing shoulder articulation while maintaining optimal weight and cost parameters.

SUMMARY OF THE INVENTION

The present invention relates to backpacks and other carrying systems which include shoulder straps for user support. One embodiment of the present invention relates to a carrying system with an enclosure member and a user attachment system. The user attachment system is configured to support the enclosure member without requiring continuous muscular engagement. The user attachment system may be a shoulder attachment system which includes a first and second shoulder strap individually rigidly coupled at a top end to the external surface of the enclosure member. The bottom end of the first and second shoulder straps are slidably intercoupled with respect to the enclosure member via a coupling member. The coupling member is slidably routed through a sleeve member within the internal region of the enclosure member. The sleeve member includes an internal channel having a cross-sectional shape that substantially matches the cross-sectional shape of the coupling member, thereby minimizing frictional resistance as the coupling member is translated through the sleeve member. The cross sectional shape of the first and second shoulder straps is substantially different from the cross section shape of the coupling member and internal channel. The slidable intercoupling between the bottom ends of the first and second shoulder straps with respect to the enclosure member enables articulation of one shoulder strap to be balanced by corresponding articulation of the opposite shoulder strap. A second embodiment of the present invention relates to a method for slidably intercoupling a first and second shoulder strap with an enclosure member to form an efficient user-based independent carrying system. The method includes positioning a sleeve member within an internal region of the enclosure member; intercoupling the bottom end of the first and second shoulder straps with a coupling member; and slidably routing the coupling member through the sleeve member within the internal region and between the first and second shoulder strap.

The present invention represents a significant advance in the field of carrying case shoulder attachment systems. Embodiments of the present invention provide a system by which certain types of opposing shoulder articulations may be balanced without requiring excess work resulting from muscularly manipulating the contents of the enclosure portion. Therefore, as a user leans or raises one shoulder, the system is configured to lengthen the corresponding shoulder strap and shorten the opposite shoulder strap via the slidable intercoupling between the bottom ends. Conventional shoulder attachment systems are rigidly coupled at both the top and bottom ends to the enclosure portion of the backpack, resulting in excess work in response to opposing shoulder movements. Existing shoulder strap articulation systems have failed to efficiently accommodate opposing shoulder movement because they include significant frictional resistance between the bottom ends of the shoulder straps, thereby impeding the ability for the system to accommodate the opposing shoulder movements.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1:
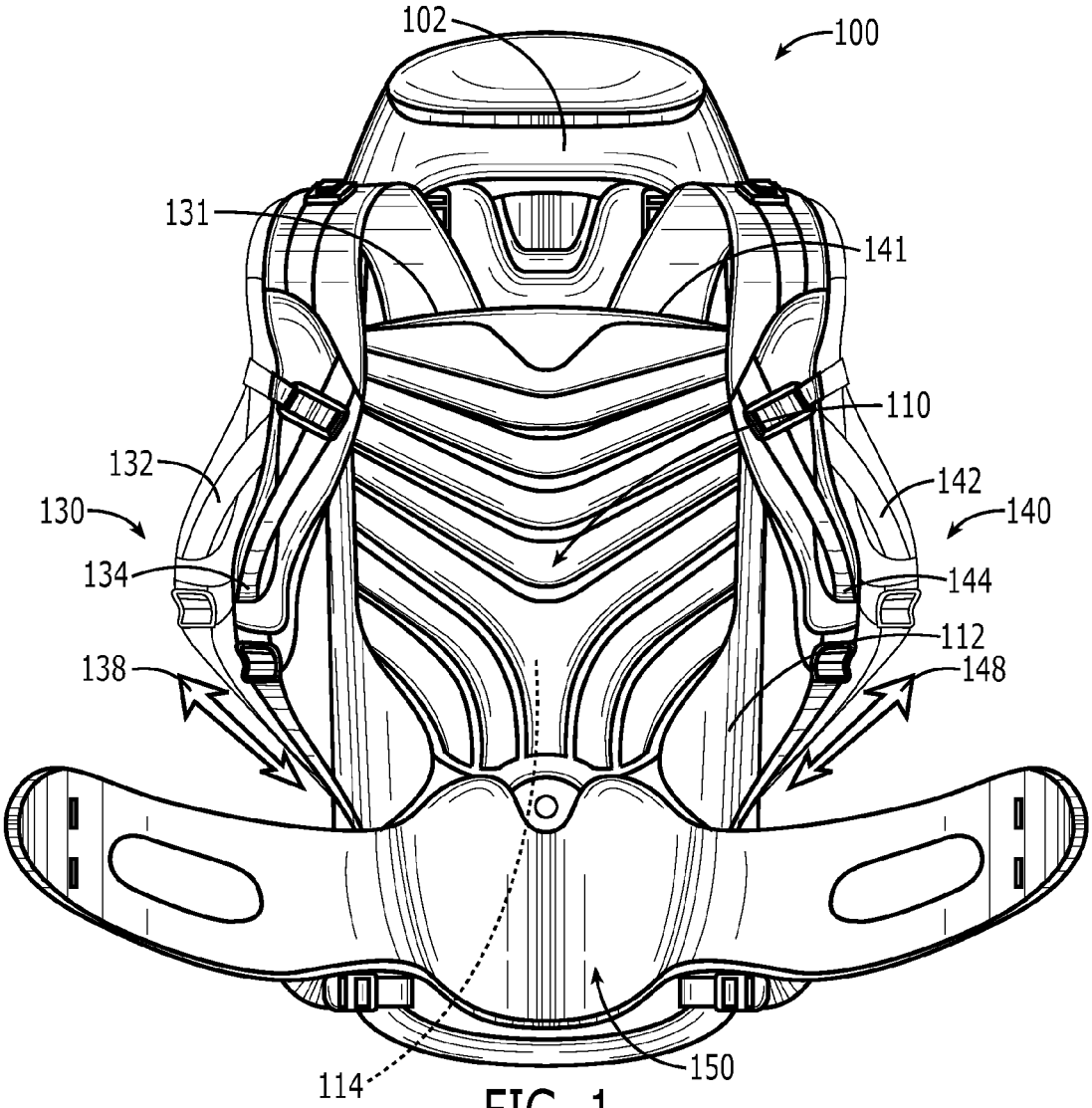
FIG. 1 illustrates a rear operational view of a carrying case in accordance with embodiments of the present invention.

The present invention relates to backpacks and other carrying systems which include shoulder straps for user support. One embodiment of the present invention relates to a carrying system with an enclosure member and a user attachment system. The user attachment system is configured to support the enclosure member without requiring continuous muscular engagement. The user attachment system may be a shoulder attachment system which includes a first and second shoulder strap individually rigidly coupled at a top end to the external surface of the enclosure member. The bottom end of the first and second shoulder straps are slidably intercoupled with respect to the enclosure member via a coupling member. The coupling member is slidably routed through a sleeve member within the internal region of the enclosure member. The sleeve member includes an internal channel having a cross-sectional shape that substantially matches the cross-sectional shape of the coupling member, thereby minimizing frictional resistance as the coupling member is translated through the sleeve member. The cross sectional shape of the first and second shoulder straps is substantially different from the cross section shape of the coupling member and internal channel. The slidable intercoupling between the bottom ends of the first and second shoulder straps with respect to the enclosure member enables articulation of one shoulder strap to be balanced by corresponding articulation of the opposite shoulder strap. A second embodiment of the present invention relates to a method for slidably intercoupling a first and second shoulder strap with an enclosure member to form an efficient user-based independent carrying system. The method includes positioning a sleeve member within an internal region of the enclosure member; intercoupling the bottom end of the first and second shoulder straps with a coupling member; and slidably routing the coupling member through the sleeve member within the internal region and between the first and second shoulder strap. Also, while embodiments are described in reference to shoulder attachment systems for carrying cases, it will be appreciated that the teachings of the present invention are applicable to other areas.

The following terms are defined as follows:

User-based carrying system—a carrying system configured to be secured to a user. A user-based carrying system may be further defined as being capable of independent transportation, meaning that it does not request a user to maintain an appendage based active muscular engagement. For example, a backpack or shoulder bag are user-based carrying systems that allow for independent transportation because they include one or two straps that may be looped over a user's torso during transportation. In contrast, a conventional briefcase is a user-based transportation system that is dependent on the user maintaining a continuous grasp of the handle or some form of appendage-torso compression during transportation.

Slidably intercoupled—an intercoupling of two members with respect to a third member that enables a corresponding translational movement of the two members with respect to the third member. For example, routing a string through fixed aperture may be said to be slidably intercoupled to the two ends of the string with respect to the fixed aperture because the two ends may be correspondingly translated to and away from the fixed aperture.

Supported three dimensional region—a three dimensional region that does not collapse when empty. For example, an elongated cylindrical region (circular cross-section) may be said to be a supported circular cross sectional region if the surrounding structure supports the circular cross-sectional shape when the elongated cylindrical region is empty. In contrast, a sleeve (i.e. two flat flexible members coupled together) may form an unsupported three dimensional internal region if it is filled with a particular three dimensional structure.

Rigid coupling—an intercoupling of two members that does not allow for any movement between the two members at the coupling point. For example, tying one end of a string to a fixed aperture may be said to rigidly couple the one end to the fixed aperture because the one end is unable to move with respect to the fixed aperture.

Coronal plane—a vertical anatomical plane splitting the front and rear portions.

Transverse plane—a horizontal anatomical plane splitting the top and bottom portion.

Sagittal plane—a vertical anatomical plane splitting the left and right portions.

Shoulder region—an anatomical region corresponding to a region defined within the rhomboid and trapezius muscle groups. A person possesses two shoulder regions on opposite regions in the sagittal plane.

Opposing shoulder movement—a movement of one shoulder region which is substantially balanced by a corresponding movement of the opposite shoulder region, for example raising the left shoulder and lowering the right shoulder.

Symmetrical shoulder movement—a simultaneous movement of both shoulder regions in a single orientation. For example, shrugging the shoulders sagittally raises both shoulder regions towards the users head.

Figure 2:
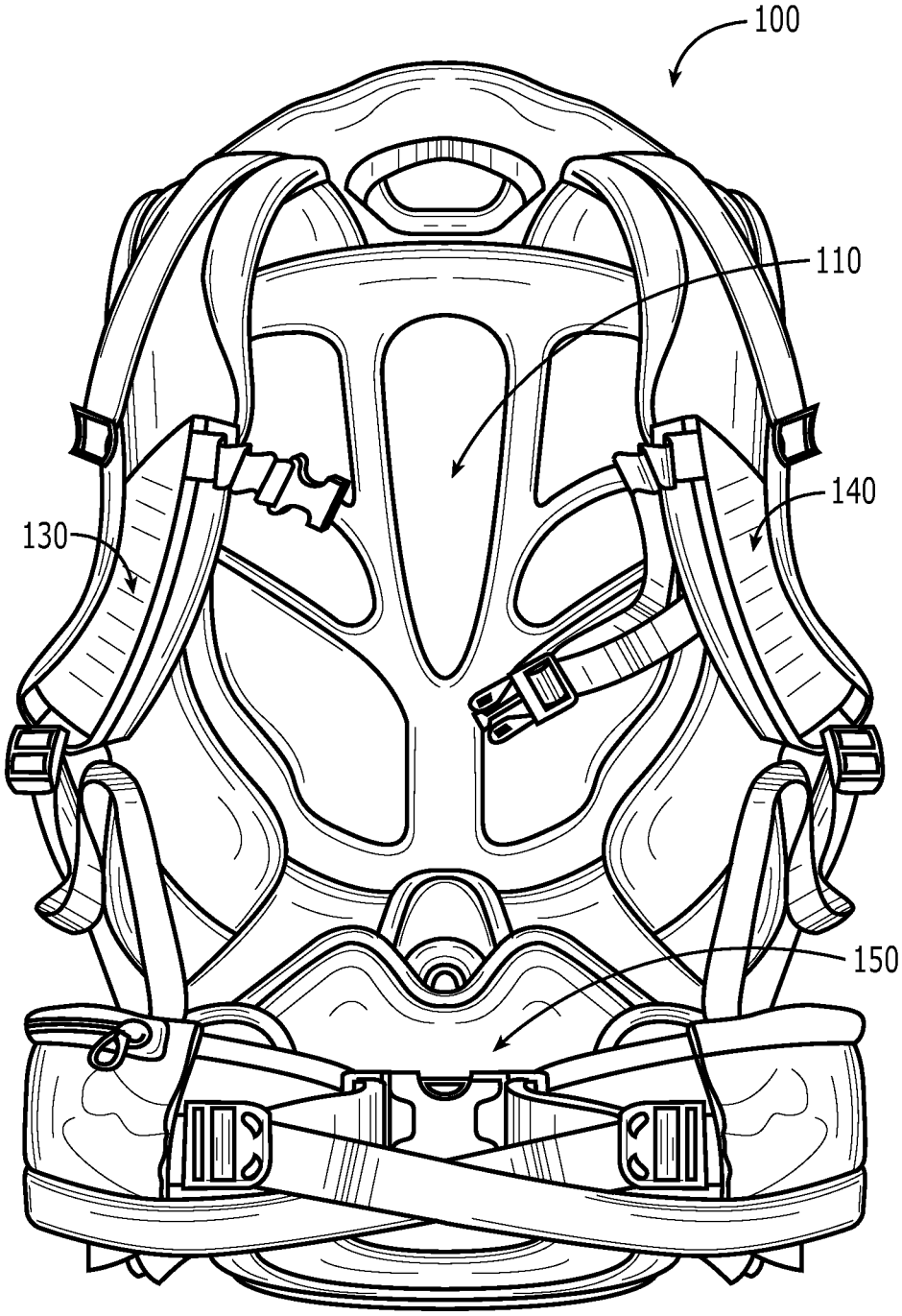
FIG. 2 illustrates a rear view of a carrying case in accordance with embodiments of the present invention.
Figure 3:
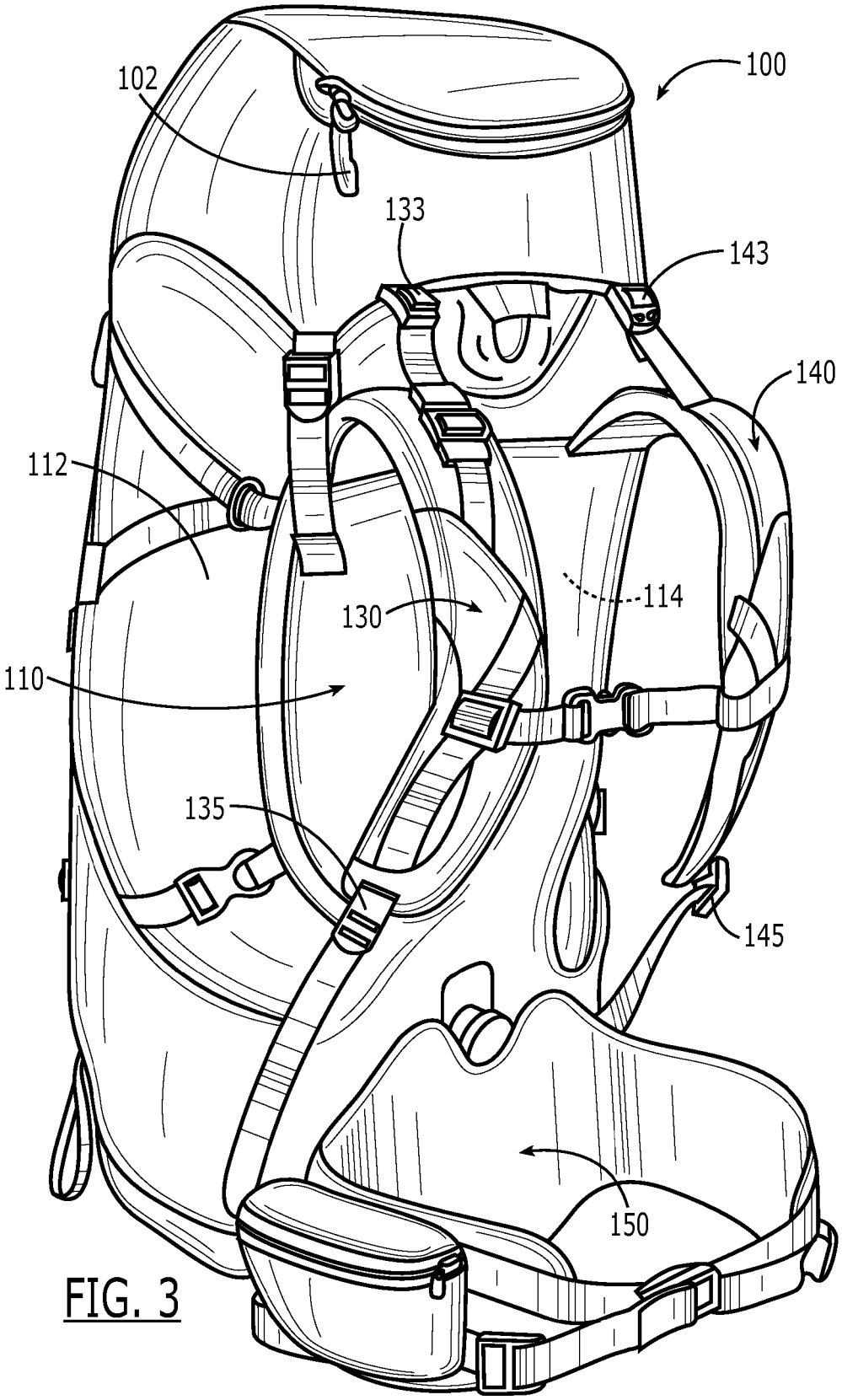
FIG. 3 illustrates a perspective view of a carrying case in accordance with embodiments of the present invention.

Reference is initially made to FIGS. 1-3, which illustrate views of a user-based carrying system, designated generally at 100. The illustrated carrying system 100 is configured to facilitate independent transportation of a load by a user. The system 100 includes an enclosure member 110 and a user-attachment system. The enclosure member 110 defines an internal region 112 substantially encased by an internal surface. The internal region 112 is a three dimensional region capable of storing items. The enclosure member 110 further includes an external surface 112 and a lid 102. The external surface 112 is opposite the internal surface. The lid 102 is selectively disposed over an upper opening to the enclosure member. Various other well known components of an enclosure member 110 may be included in accordance with embodiments of the present invention, including but not limited to compression straps, padding, secondary openings to the internal region, external storage compartments, sleeves, pockets, etc. The illustrated user attachment system further includes a hip-attachment system 150 and a first and second shoulder strap 130, 140. The shoulder straps 130, 140 are configured to extend vertically or sagittally around the shoulder regions of a user, thereby encircling the shoulder straps 130, 140 and the enclosure member 110 around the user's shoulder regions. The shoulder straps 130, 140 are rigidly individually coupled at a top end to the external surface of the enclosure member 110. The coupling point 131, 141 between the shoulder straps 130, 140 and the enclosure member 110 is a sagitally oriented point on the external surface of the enclosure member 110 corresponding to the position of the shoulder region of a user. The bottom ends of the shoulder straps 130, 140 are slidably intercoupled with respect to the enclosure member 110 via a coupling member 190 (see FIGS. 4A-4B). Therefore, the bottom ends of the shoulder straps 130, 140 are capable of translationally moving to and away from the enclosure member respectively. The movement and intercoupling scheme between the shoulder straps 130, 140 will be described in more detail below. Various additional shoulder strap lengthwise adjustment members may be included such as the upper and lower pull-tabs 133, 135, 143, 145 shown on the illustrated carrying system 100 embodiment. The coupling member 190 is disposed between the bottom ends of the shoulder straps 130, 140, within a sleeve member 160 (see FIGS. 4A-4B), and within the internal region 112 of the enclosure member 110. The illustrated waist attachment system 150 is optional for utilization of concepts related to embodiments of the present invention. The illustrated waist attachment system 150 is one example of a waist attachment system and is not functionally related to the operation of the shoulder attachment system described herein. It will be appreciated that various shapes and configurations of enclosure members 110 may be utilized in conjunction with embodiments of the shoulder attachment system of the present invention.

The carrying system 100 facilitates articulation of the shoulder straps 130, 140 in response to user movements during operation. FIG. 1 illustrates multiple movement states of the first and second shoulder straps 130, 140. The first shoulder strap 130 is illustrated with a first extended state 132 and a first compressed state 134. The second shoulder strap 140 is illustrated with a second extended state 142 and a second compressed state 144. The slidable intercoupling between the shoulder straps 130, 140 and the enclosure member 110 enables simultaneous opposite movement of the respective shoulder straps 130, 140 with respect to the enclosure member 110. For example, the first shoulder strap 130 may translate to the first extended state 132 while the second shoulder strap 140 simultaneously translates to the second compressed state 144. Likewise, the second shoulder strap 140 may translate to the second extended state 142 while the first shoulder strap 130 simultaneously translates to the first compressed state 134. The movement arrows 138, 148 illustrate the respective simultaneous opposite movements of the first and second shoulder straps 130, 140. The simultaneous opposite movements of the first and second shoulder straps 130, 140 facilitate accommodating for opposing shoulder movements during operation. For example, when a user lowers one shoulder, the corresponding shoulder strap may translate to the compressed state while the opposite shoulder strap translates to the extended state, thereby avoiding significantly moving or tilting the enclosure member which would result in unnecessary muscular work imposed on the user.

Figure 4A:
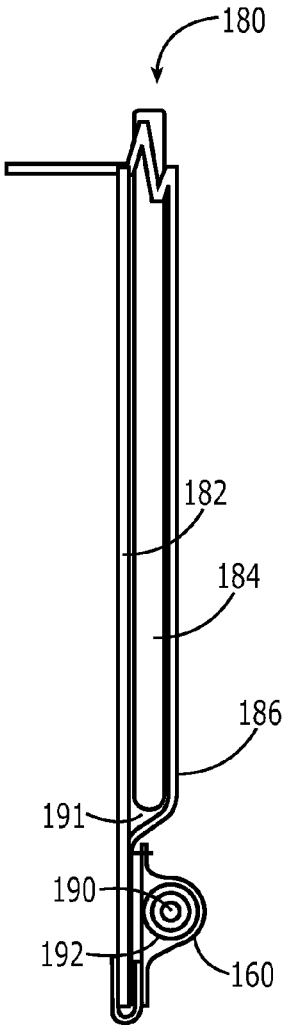
FIGS. 4A-4B illustrate cross-sectional and profile views of the frame portion disposed within the internal region of the carrying case illustrated in FIGS. 1-3.

Reference is next made to FIG. 4A, which illustrates profile views of a frame member 180 configured to be disposed within the internal region 112 of the carrying system 100 illustrated in FIG. 1. The illustrated frame member 180 provides structural support to the carrying system 100 during operation. In particular, the frame member 180 is oriented adjacent to the internal surface portion which corresponds to the region at which the shoulder straps 130, 140 are attached. The frame member 180 is configured to indirectly engage the dorsal side of a user's body through the enclosure member 110. In the illustrated enclosure member 110 of FIGS. 1-3 this region includes a ribbed padded area on the external surface of the enclosure member 110. The illustrated frame member 180 includes a frame sheet 182, frame pocket 186, and a frame support 184. The frame sheet 182 defines the two dimensional area of the frame member 180 and provides an attachment surface for coupling other components. The frame sheet 182 is positioned directly adjacent to the internal surface of the enclosure member 110. The frame pocket 186 is coupled to the frame sheet 182 to create a secondary internal region therebetween. The frame support 184 is disposed within the secondary internal region of the frame pocket 186 as illustrated in FIG. 4A. The frame pocket 186 may includes a releasable opening to allow a user to insert/remove the frame support 184. The frame support 184 is an elongated semi-rigid or rigid member that provides sagittal or vertical structural support to enclosure member 110 and the carrying system 100. Various compositions may be utilized for the frame support 184, including but not limited to plastic and metal. The frame support 184 is shaped with a particular lengthwise axis that corresponds to the orientation and length of a user's spine and/or back. The frame pocket 186 is coupled to the frame sheet 182 in a configuration to maintain proper orientation of the frame member with respect to the frame sheet. The coupling configuration between the frame pocket 186 and the frame sheet 182 further defines two independent secondary regions 191, 192 within the secondary internal region. A primary secondary internal region 191 encases the frame support 184, and a secondary internal region 192 encases a sleeve member 160. The coupling scheme of the frame pocket 186 configures the primary and secondary internal regions 191, 192, so as to support the frame support 184 sagittally above the sleeve member 160 on the frame member 180 in the illustrated configuration. The sleeve member 160 is an elongated structure including an internal channel extending lengthwise within an outer structure. The sleeve member 160 may be composed of a flexible plastic material such as a cable brake housing conventionally used on a bicycle brake system. The external cross-sectional shape of the sleeve member 160 may correspond to the cross-sectional shape of the internal channel. The sleeve member 160 is oriented substantially perpendicular to the lengthwise axis of the frame member 180 and/or in a substantial horizontal orientation. The internal channel is cross-sectionally shaped to match the cross-sectional shape of the coupling member 190. The internal channel of the sleeve member 160 may also be a supported three dimensional shape meaning that it does not collapse when empty. The coupling member may be composed of a flexible metal material such as a cable brake conventionally used on a bicycle brake system. In the illustrated embodiment, the cross-sectional shape of the coupling member 190 and the internal channel is circular. The cross-sectional shape matching between the internal channel and the coupling member 190 includes shaping the coupling member 190 to a corresponding size and shape so as to fit within the internal channel for optimal translational movement. The cross-sectional shape matching facilitates a substantially frictionless slidable routing of the coupling member 190 with respect to the sleeve member 160. The ends of the coupling member 190 are coupled to the first and second shoulder straps 130, 140 respectively. Therefore, the substantially frictionless routing of the coupling member 190 within the internal channel facilitates the slidable intercoupling of the shoulder straps 130, 140 with respect to the enclosure member 110. The cross-sectional shape of the shoulder straps 130, 140 is different from cross-sectional shape of the coupling member 190 and the internal channel. In the illustrated embodiment, the cross-sectional shape of the shoulder straps 130, 140 is substantially rectangular to allow flat engagement along the shoulder regions of the user.

Figure 4B:
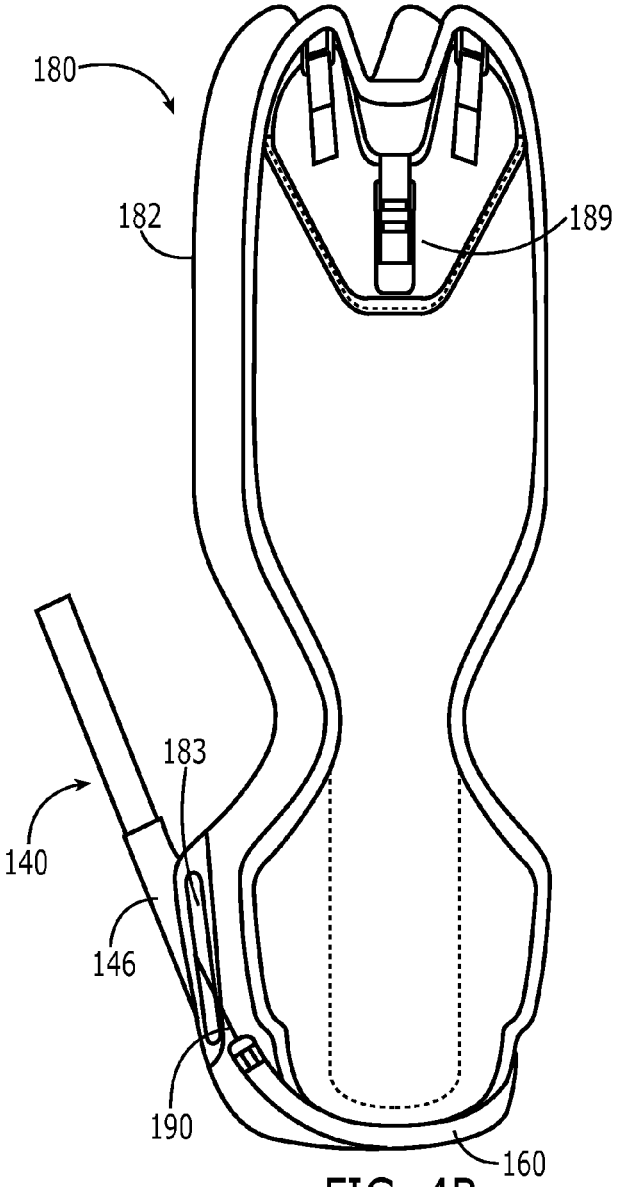

Reference is next made to FIG. 4B which illustrates a perspective view of the frame member 180. The second shoulder strap 140 is coupled to the coupling member 190 through a recess 183 in the frame sheet 182. An optional intermediary coupler 146 is disposed between the second shoulder strap 140 and the coupling member 190 for reliable coupling and concealment of the coupling member 190. The intermediary coupler 146 may be a sleeve within which the coupling member 190 is directly coupled to the second shoulder strap 140. The coupling member 190 may extend on one or both sides of the frame sheet 182. In addition, the coupling member 190 may extend external to the internal region 112 of the enclosure member 110. The ends of the coupling member 190 are coupled to the shoulder straps 130, 140, while the middle is slidably routed through the sleeve member 160. As discussed above, the slidable routing of the coupling member 190 through the sleeve member 160 facilitates the slidable intercoupling of the two shoulder straps 130, 140 with respect to the enclosure member 110. As illustrated, the sleeve member 160 and coupling member 190 may include a concave curvature to further minimize frictional translation therebetween. In addition, the frame pocket 186 includes a reinforced region 189. The reinforced region 189 may correspond to the rigid coupling points 131, 141 (see FIG. 1) of the top ends of the shoulder straps 130, 140. In addition, the reinforced region 189 may includes a releasable opening that enables the insertion and extraction of the frame support 184 from the frame member 180.

Alternatively, the coupling member 190 and sleeve member 160 may be composed of other flexible materials having different cross-sectional shapes. For example, the coupling member 190 may be composed of nylon webbing, and the sleeve member 160 may be a rectangularly sewn sleeve or recess.

In operation, when a user engages the carrying system 100 (i.e. the shoulder straps 130, 140 encircling their shoulder regions and having the enclosure member 110 disposed on the dorsal torso region) performs an opposing shoulder region movement such as raising the left shoulder as they take a step forward with their right foot, the carrying system 100 is configured to extend the left shoulder strap 140 to compensate for the left shoulder movement. The extension of the left shoulder strap 140 in this scenario thereby prevents the user from unnecessarily performing the work associated with muscularly raising the weight of the enclosure member 110. The extension of the left shoulder strap 140 is effectuated by slidably lengthwise translation of the right shoulder strap 130 toward the left shoulder strap 140. Therefore, the exposed region of the right shoulder strap 130 is shortened or compressed as the bottom end is slidably translated toward the left shoulder strap 140 via the coupling member 190. The lengthwise extension of the exposed portion of the left shoulder strap 140 is thereby balanced by the lengthwise shortening of the exposed portion of the right shoulder strap 130.

The lengthwise coupling of the shoulder straps 130, 140 effectively accommodates opposing shoulder movements but does not diminish optimal support by accommodating symmetrical shoulder movements. This is advantageous because small incidental opposing shoulder movements would otherwise force the user to raise the contents of the enclosure member to accommodate. However, symmetrical shoulder movements are part of efficiently supporting a load using a dual shoulder strap user attachment system. For example, if a user shrugs both shoulder regions upward, the described shoulder articulation system will not lengthwise adjust either shoulder strap 130, 140 because such a movement cannot be balanced. The absorption of symmetrical movements (i.e. such as using an elastic material on both shoulder straps) introduces a lengthwise slack which diminishes efficient support characteristics of a backpack.

One non-illustrated minimal alternative embodiment of a carrying case with a shoulder strap attachment system may include a frameless enclosure member. The shoulder straps 130, 140 may be coupled and oriented in substantially the same manner described above. The coupling member 190 and sleeve member 160 may be directly routed through an internal region of the enclosure member 110 without utilization of a sewn region or a frame assembly.

A second embodiment of the present invention relates to a method for slidably intercoupling a first and second shoulder strap with an enclosure member forming an efficient user-based independent carrying system. The method includes positioning a sleeve member within an internal region of the enclosure member. The shoulder straps are intercoupled with a coupling member having a cross sectional shape that substantially matches the cross-sectional shape of an internal channel of the sleeve member. The coupling member is slidably routed through the sleeve member within the internal region and between the first and second shoulder strap.

Various other embodiments have been contemplated, including combinations in whole or in part of the embodiments described above. Various additional components and or materials may be used in conjunction with embodiments of the present invention.

What is claimed is:

1. A user-based carrying system capable of independent transportation of a load, comprising:

an enclosure member having an internal region substantially encased by an internal surface, wherein the enclosure member includes an external surface opposite the internal surface;

a user attachment system configured to releasably secure the enclosure member to a user, wherein the user attachment system includes a shoulder attachment system comprising:

a first shoulder strap having a top and bottom end, wherein the first shoulder strap top end is rigidly individually coupled to the external surface of the enclosure member;

a second shoulder strap having a top and bottom end, wherein the second shoulder strap top end is rigidly individually coupled to the external surface of the enclosure member;

wherein the bottom end of the first and second shoulder strap are intercoupled via a coupling member, and wherein the coupling member is slidably routed through a sleeve member disposed within the internal region of the enclosure member and between the first and second shoulder straps, and wherein the sleeve member includes an internal channel having a cross-sectional shape that substantially matches the cross-sectional shape of the coupling member, and wherein the coupling between the coupling member and the first and second shoulder straps is disposed within the internal region of the enclosure member; and a frame member disposed entirely between the top end of the first and second shoulder strap and the sleeve member, and wherein the frame member is disposed within the internal region of the enclosure member, and wherein the frame member includes the frame sheet, a frame pocket, and a frame support, and wherein the frame sheet is disposed adjacent to the internal surface of the enclosure member, and wherein the frame pocket forms a second internal region on the frame sheet on a side opposite the internal surface of the enclosure member, and wherein the frame support is disposed within the second internal region.

2. The system of claim 1, wherein the cross sectional shape of the internal channel is a supported three dimensional shape.

3. The system of claim 1, wherein the cross sectional shape of the coupling member and the internal channel is substantially circular, and wherein the cross sectional shape of the first and second shoulder straps is substantially rectangular.

4. The system of claim 1, wherein the cross sectional shape of the coupling member and the internal channel is substantially different from the cross sectional shape of the first and second shoulder straps.

5. The system of claim 1, wherein the sleeve member is disposed within the second internal region.

6. The system of claim 5, wherein the second internal region includes an independent primary and secondary region, and wherein the frame support is disposed within the primary region and the sleeve member is disposed within the secondary region, and wherein the secondary region is disposed below the primary region.

7. The system of claim 1, wherein the coupling member extends through two recesses on the frame sheet on either side of the sleeve member.

8. The system of claim 1, wherein the coupling member and sleeve member are oriented substantially perpendicular to the lengthwise orientation of the enclosure member.

9. The system of claim 1, wherein the first and second shoulder straps are slidably intercoupled with respect to the enclosure member.

10. The system of claim 1, wherein the coupling member is substantially composed of metal and the sleeve member is substantially composed of rubber.

11. The system of claim 1, wherein the slidable routing of the coupling member with respect to the sleeve member is substantially frictionless.

12. A user-based carrying system capable of independent transportation of a load, comprising:

an enclosure member having an internal region substantially encased by an internal surface, and the enclosure member includes an external surface opposite the internal surface;

a user attachment system configured to releasably secure the enclosure member to a user, wherein the user attachment system includes a shoulder attachment system comprising:

a first shoulder strap having a top and bottom end, wherein the first shoulder strap top end is rigidly individually coupled to the external surface of the enclosure member;

a second shoulder strap having a top and bottom end, wherein the second shoulder strap top end is rigidly individually coupled to the external surface of the enclosure member;

wherein the bottom end of the first and second shoulder straps are intercoupled via a coupling member, and wherein the coupling member is slidably routed through a sleeve member disposed within the internal region of the enclosure member and between the first and second shoulder straps, and wherein the sleeve member includes an internal channel having a cross-sectional shape that substantially matches the cross-sectional shape of the coupling member;

a frame member disposed entirely between the top end of the first and second shoulder strap and the sleeve member, and wherein the frame member is disposed within the internal region of the enclosure member, and wherein the frame member includes the frame sheet, a frame pocket, and a frame support, and wherein the frame sheet is disposed adjacent to the internal surface of the enclosure member, and wherein the frame pocket forms a second internal region on the frame sheet on a side opposite the internal surface of the enclosure member, and wherein the frame support is disposed within the second internal region;

wherein the cross sectional shape of the coupling member and the internal channel is substantially different from the cross sectional shape of the first and second shoulder straps; and wherein the slidable routing of the coupling member with respect to the sleeve member is substantially frictionless, and wherein the coupling between the coupling member and the first and second shoulder straps is disposed within the internal region of the enclosure member.

13. The system of claim 12, wherein the cross sectional shape of the internal channel is a supported three dimensional shape.

14. A method for slidably intercoupling a first and second shoulder strap with an enclosure member forming an efficient user-based independent carrying system, comprising the acts of:

providing an enclosure member having an internal region substantially encased by an internal surface;

providing a first and second shoulder strap with a cross sectional shape;

providing a coupling member having a cross sectional shape that is substantially different from the cross sectional shape of the first and second shoulder straps;

providing a frame member within the internal region adjacent to the internal surface;

positioning a sleeve member within the internal region having an internal channel with a supported cross-sectional shape, wherein the frame member is disposed between the top end of the first and second shoulder strap and the sleeve member;

rigidly individually coupling a top end of the first and second shoulder strap to the enclosure member;

intercoupling the bottom end of the first and second shoulder straps with the coupling member having a cross sectional shape that substantially matches the supported cross-sectional shape of the internal channel including coupling the bottom end of the first and second shoulder straps with the coupling member within the internal region; and slidably routing the coupling member through the sleeve member within the internal region and between the first and second shoulder strap; and wherein the frame member is disposed entirely between the top end of the first and second shoulder strap and the sleeve member, and wherein the frame member is disposed within the internal region of the enclosure member, and wherein the frame member includes the frame sheet, a frame pocket, and a frame support, and wherein the frame sheet is disposed adjacent to the internal surface of the enclosure member, and wherein the frame pocket forms a second internal region on the frame sheet on a side opposite the internal surface of the enclosure member, and wherein the frame support is disposed within the second internal region.

15. The method of claim 14, wherein the act of slidably routing the coupling member through the sleeve member within the internal region and between the first and second shoulder strap is substantially frictionless.

16. The method of claim 14, wherein the act of positioning a sleeve member within the internal region having an internal channel with a supported cross-sectional shape includes positioning the sleeve member perpendicular to the lengthwise orientation of the enclosure member within a secondary internal region adjacent to a frame member.

* * * * *